US005121287A

United States Patent [19]

Lee

[11] Patent Number: 5,121,287

[45] Date of Patent: Jun. 9, 1992

[54] RECEIVER/ADAPTER FOR LAMP CONTROL

[76] Inventor: Wade Lee, 1394 Danville Blvd., Alamo, Calif. 94507

[21] Appl. No.: 491,890

[22] Filed: Mar. 12, 1990

[51] Int. Cl.[5] ..... H01J 5/54

[52] U.S. Cl. ..... 361/331; 313/51; 362/95; 439/628

[58] Field of Search ..... 362/95, 364, 365, 366, 362/368, 184, 190, 448; 361/331, 380, 383, 395; 200/310, 51 R; 313/51, 318; 307/146, 147, 157; 340/815.01, 815.2; 439/628, 168, 220, 236, 254, 302, 303, 360, 661, 662, 667, 682

[56] References Cited

U.S. PATENT DOCUMENTS

| | | | |
|---|---|---|---|
| 3,128,444 | 4/1964 | Kafka | 340/15 |
| 3,331,013 | 7/1967 | Cunningham | 323/22 |
| 3,450.941 | 6/1969 | Butts | 315/194 |
| 3,452,215 | 6/1969 | Alessio | 307/146 |
| 3,496,451 | 2/1970 | Duncan | 323/16 |
| 3,543,088 | 11/1970 | Garrett | 315/272 |
| 4,101,805 | 7/1978 | Stone | 315/74 |
| 4,174,517 | 11/1979 | Mandel | 340/310 |
| 4.329,678 | 5/1982 | Hatfield | 340/310 |
| 4,688,874 | 8/1987 | Bjorkman | 439/56 |
| 5,006,751 | 4/1991 | Marshall | 313/51 |

OTHER PUBLICATIONS

Advertising Brochure of Square D Company, Consumer Products Division (Palatine, Ill.), undated.

*Primary Examiner*—Gerald P. Tolin

*Attorney, Agent, or Firm*—Townsend and Townsend

[57] ABSTRACT

An adapter unit, having a body portion for containing circuitry to control a light bulb, and a threaded socket to receive the light bulb, is formed and configured to have a threaded extension to be received by a lamp socket, recessed into the body, lowering the vertical profile of the light bulb/adapter unit combination.

11 Claims, 1 Drawing Sheet

RECEIVER/ADAPTER FOR LAMP CONTROL

The present invention relates generally to apparatus for controlling electrical appliances and, in particular, to an adapter unit that houses electronic circuitry to control a light bulb, the body of the adapter being structured and configured to have a reduced vertical profile.

BACKGROUND OF THE INVENTION

Many devices and apparatus exist to control light bulbs, in addition to the conventional and well-known on-off switching typically provided. Many of these devices are for use in lamps of the type in which a light bulb is threaded into a lamp socket. These latter devices incorporate an adapter unit that adapted to be interposed between the light bulb and the lamp socket, and contain or carry the control mechanisms for varying electrical current applied to the light bulb. Thus, for example, U.S. Pat. No. 3,331,013 teaches a dimmer control device in the form of an adapter unit structured to be received by the lamp socket and, in turn, receive a light bulb. The adapter unit is operable to (locally) control dimming of the light bulb. Other patents of the same genre include U.S. Pat. Nos. 3,450,941, 3,452,251, 3,496,451, 3,543,088 and 4,688,074.

Another adapter of the type to which the present invention is directed is manufactured by the Consumer Products Division of Square D Company of Palatine, Ill. 60067. This adapter unit forms part of a remote control light system that is sold under the part number RLD-100-D, and is constructed carry remotely controlled electronic circuitry to control current to the light bulb. The system includes, in addition to the adapter, a transmitter unit, generating signals for receipt by the circuitry housed within the adapter.

All of the adapters units heretofore known suffer from at least one problem. Since they are to be interposed, or otherwise situated, between the light bulb and the power-providing lamp socket of a lamp, they tend to move the light bulb away from the socket. If there is mounting apparatus associated with the lamp (e.g., that used for mounting and holding lamp shades, or for containing the lamp structure, in the case of outdoor lamps), such mounting apparatus can tend to interfere use of the adapter unit. That is, since the adapter physically positions the light bulb away from the bulb-receiving socket, the mounting structure may inhibit such repositioning. Accordingly, the mounting structure must be modified to accommodate the new position of the light bulb caused by the use of an adapter, or the adapter cannot be used.

This problem can be exacerbated when the amount of control circuitry causes the adapter to increase in size.

SUMMARY OF THE INVENTION

The present invention is directed to an adapter unit having a lower profile than heretofore known with such adapter units. The adapter unit of the present invention is structured to minimize re-location of the light bulb when used, yet is inexpensive to manufacture, and easy to use.

The preferred embodiment of the adapter unit of the present invention comprises a body element in which is formed a socket for receiving the threaded stem of a light bulb, a recess or cavity formed in the body element, and, mounted in the cavity, a threaded extension that is adapted to be screwed into the bulb-receiving socket of a lamp. The body element is structured to contain the electronic circuitry to control lamp current (whether local or remote control is used), and the cavity is configured to encircle and contain a substantial portion of the threaded extension within the body element. This recessing of the threaded extension into the body element, moving it into the body element, effectively lowers overall the vertical profile of the adapter unit.

A number of advantages can now readily be evident to those skilled in this art. First and foremost is the fact that lamp control apparatus utilizing adapter units of the type to which the present invention is directed may now be used whereas before such adapter apparatus tended to move the light bulb into conflict with lamp-associated structure. An adapter unit with such lower profile minimizes ultimate repositioning of the light bulb within the lamp structure.

These and other advantages of the present invention will be readily apparent to those skilled in the art upon a reading of the following detailed description of the invention, which should be taken in conjunction with the accompanying drawings.

DESCRIPTION OF THE PREFERRED EMBODIMENT

Figure 1:
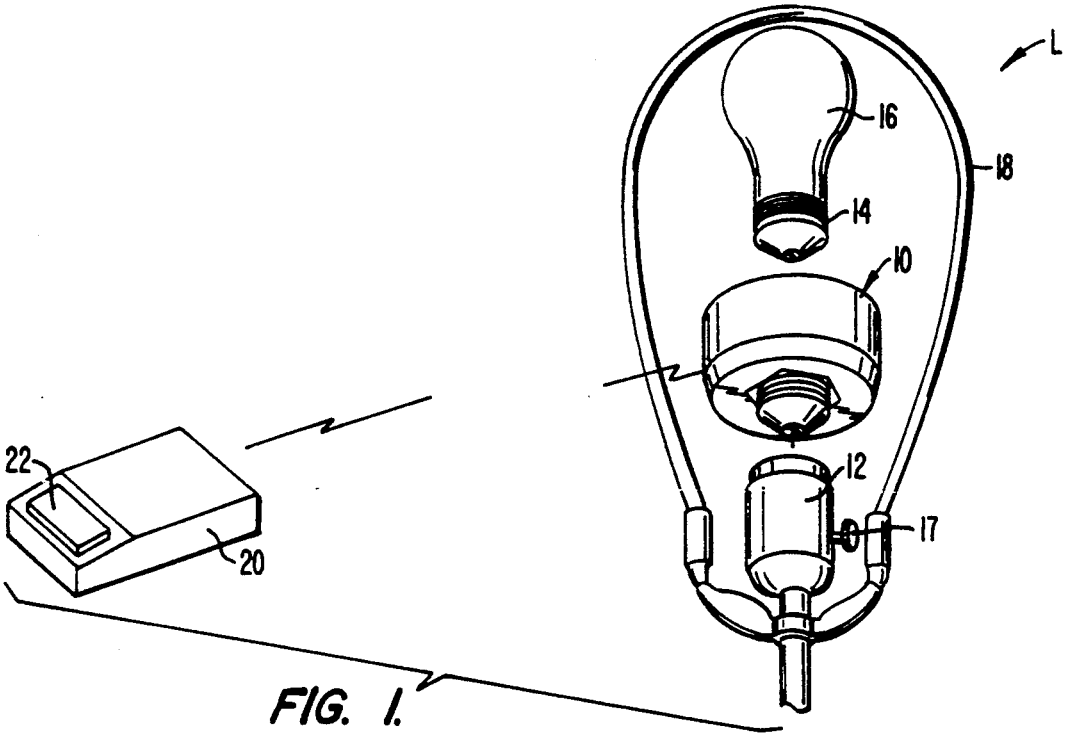
FIG. 1 is an illustrative view of the adapter of the present invention shown as forming a part of a remote control system for a light bulb, in the context of a lamp.

Turning now to the Figures, and in particular FIG. 1, the adapter unit of the present invention, designated generally by the reference numeral 10, is shown in conjunction with a lamp structure L that includes a lamp socket 12 configured and adapted to screwably receive a threaded stem 14 of a light bulb 16. An on/off switch 17 controls, in normal fashion, the supply of household current to the light bulb for lighting. As FIG. 1 further illustrates, the lamp structure L includes a conventional mounting bracket 18 for receiving and holding a lamp shade.

The lamp structure L is of general design, constructed for local control of the light bulb via the on/off switch 17. As hereinbefore indicated, however, there exists various apparatus available that can provide additional control over the light bulb 16. In FIG. 1, illustrated as an example only, is one such apparatus: A remote control system that incorporates the adapter unit 10, includes a remotely-locatable transmitter unit 20 activated by, for example, a finger-depressible switch 22 to issue an electromagnetic or other type of emission that is received by responsive electronics (not shown) housed in the adapter unit 10. The electronics in the adapter unit 10 thereby responds with control of current from the light socket 12 to the threaded stem 14 of the light bulb 16 to, for example, turn the light bulb on, off, or otherwise affect its light output (e.g., dimming).

Remote control apparatus, such as that generally described above, is well known to those ,skilled in the art, as indicated above with respect to that of Square D Company, and does not form a part of the present invention, except insofar as such apparatus can benefit from use of the adapter unit 10 of the present invention.

Further, other devices do not use remote control, but do use an adapter unit to effect dimming or other control over the light bulb 16. These latter devices will also benefit from the teachings presented herein, and use of the present invention.

Figure 3:
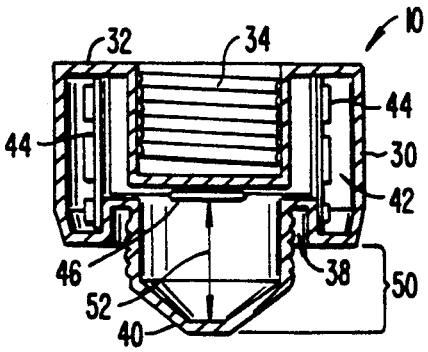
FIG. 3 is a sectional view of the adapter of the present invention.
Figure 2:
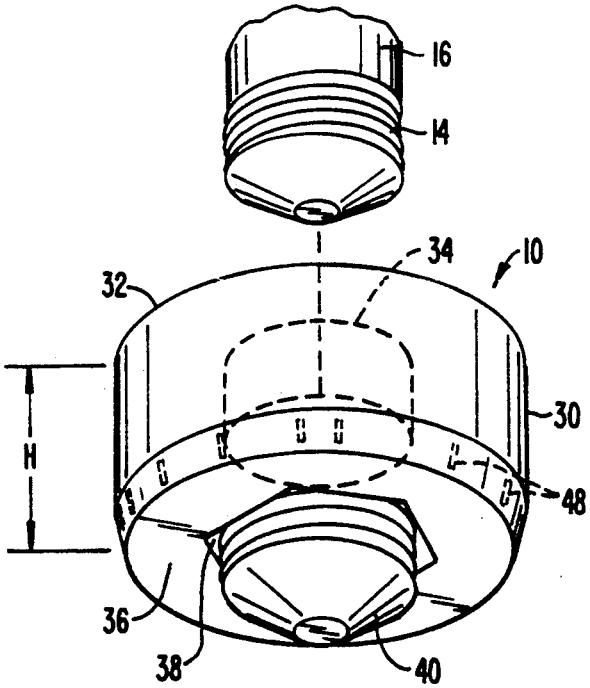
FIG. 2 is an isometric view of the adapter of the present invention to illustrate the recessed threaded extension.

Returning to the Figures, and in particular FIGS. 2–3, where the adapter 10 of the present invention is illustrated in greater detail, as shown, the adapter unit is constructed to have a generally annular body 30. At one end 32 of the body 30 is formed a threaded socket 34 configured and adapted to receive the threaded stem 14 of the light bulb 16. At the other end 36 of the body 30 is formed an annular recess or cavity 38 in which is mounted to extend a threaded extension 40. The threaded extension 40 is configured to resemble the threaded stem 14 of the light bulb 16, so that it (the threaded stem 14) can be screwed into the lamp socket 12.

Referring to FIG. 3, which shows the adapter 10 in section, it can be seen that the annular body 30 is provided with a hollow interior 42 in which is mounted control electronics 44 that operably controls electrical current from the threaded extension 40 to the socket 34 in response to the emissions from the transmitter unit 20 (FIG. 1).

Preferably, the body 30 of the adapter unit 10 is fabricated from an insulative material, such as porcelain. Further, the diameter of the body 10 is dictated, in part, by the amount of the controlled electronics 44 needed to effect current control from the light socket 12 to the light bulb 16. In addition, it may be necessary to provide cooling for such electronics and, therefore, apertures 48 may be formed in the adapter 10 such as illustrated in phantom in FIG. 2.

In operation, when it is desired to use the remote control system to control lighting of the lamp 12, the light bulb 14 is removed from the lamp socket 12, and replaced with the adapter unit 10, the threaded extension 40 of the adapter being screwed into the light socket 12. Then, the threaded stem 14 of the light bulb 16, in turn, is screwed into the threaded socket 34 of the adapter. The light emitted by the light bulb 16 can thereby be controlled, such as by the remote control apparatus illustrated in FIG. 1 (including the transmitter 20), or other means, as established by the control electronics 44 housed within the adapter 10 (FIG. 3).

Of particular note is the fact that the adapter unit 10 of the present invention will relocate the light bulb 16 from the light socket 12 a distance that is less than prior known like adapter units. Obviously, as FIG. 1 illustrates, the repositioning of the light bulb 16 is a function of the structure of the adapter 10. Often, there will be lamp structure, such as the mounting bracket 18, that can impede such repositioning, making it difficult if not impossible to use such adaptive additional control apparatus. The present invention alleviates this problem.

As particularly illustrated in FIG. 3, only a small portion 50 (approximately one-third as illustrated in FIG. 3) of the longitudinal length 52 of the threaded extension 40 extends from the end 36 of the body 30 of adapter 10. The remainder of the longitudinal length 52 of the threaded extension is contained within the cavity 38. Thereby, as illustrated in FIG. 2, the overall profile of the adapter 10 is lowered so that relocation of the light bulb 16 from the light socket 12 (FIG. 1) is reduced from that heretofore known.

Thus, there has been described an adapter unit for use in lighting structure such as the lamp apparatus L described herein, that is constructed in a manner that minimizes relocation of the light bulb 16 from the conventional light socket 12. However, it should be obvious to those skilled in the art that various modifications can be made to the adapter of the present invention without departing from the true spirit and scope of the invention.

What is claimed is:

1. An adapter for a system of the type to remotely control an electrical light bulb of the type having a threaded stem for electrical connection to a matingly configured receptive lamp socket having an annular sidewall defining an internally threaded receptacle for receiving the threaded stem of the light bulb, the adapter operating to mount the light bulb to the lamp socket, the adapter including electronic means responsive to a remotely located control device for controlling communication of electrical power from the light socket to the light bulb, the adapter comprising:

a body portion carrying and containing the electronic means, there being a cavity defining internal sidewalls formed in the body portion;

a socket formed in the adapter for threadably receiving the threaded stem of the light bulb; and a threaded extension formed and configured to be matably received by the lamp socket, the threaded extension extending into the cavity of the body portion in a manner that has the internal sidewalls of the cavity in surrounding relation to at least a portion of the threaded extension, the threaded extension and the cavity being dimensioned so that a space is formed therebetween in which is received at least a portion of the annular sidewall of the lamp socket.

2. The adapter of claim 1, wherein the body portion is formed from an electrically insulative material.

3. The adapter of claim 1, wherein the socket and the cavity formed in the body portion are generally co-linear to one another.

4. The adapter of claim 1, wherein the cavity of the body portion surrounds more than one half of the predetermined length of the threaded extension.

5. The adapter of claim 1, wherein the cavity of the body portion encircles at least one-third of the predetermined length of the threaded extension.

6. An adapter for use in lamp apparatus of the type including a light socket having an annular sidewall defining an internally threaded receptacle for receiving a threaded stem of a light bulb, the adapter operating to mount a light bulb having a threaded stem to the light socket for controllably communicating electrical power thereto, the adapter including electronic means to effect control of communication of electrical power from the light socket to the light bulb, the adapter comprising:

a body element carrying and containing the electronic means, there being a generally annular cavity located in the body portion;

a threaded adapter socket formed in the body element for receiving the threaded stem of the light bulb;

a threaded extension matably received by the light socket of the lamp apparatus, the threaded extension extending into the cavity of the body element in generally co-linear relation with the threaded adapter socket and so that a portion of the threaded extension is surrounded by the cavity, and the remaining portion of the threaded extension extends out of the cavity, the threaded extension and the cavity being dimensioned to provide a space that receives at least a portion of the annular sidewall of the light socket.

7. The adapter of claim 6, wherein the body portion is formed from an electrically insulative material.

8. The adapter of claim 6, wherein the socket and the cavity formed in the body portion are generally colinear and concentric to one another.

9. The adapter of claim 7, wherein the cavity of the body portion surrounds more than one half of the predetermined length of the threaded extension.

10. The adapter of claim 7, wherein the cavity of the body portion encircles at least one-third of the predetermined length of the threaded extension.

11. An adapter for use in lamp apparatus of the type including an electrical light bulb having a threaded stem in electrical connection with a matingly configured threaded recess of a light socket having an outer annular surface concentric with and defining the threaded recess of the lamp socket, the adapter operable to mount the light bulb to the light socket for controllably communicating electrical power thereto, the controller adapter including electronic means responsive to a controller means to effect control of communication of the electrical power from the light socket to the light bulb, the adapter comprising:

a body element, of an insulative material, and having a generally annular cavity formed therein;

a threaded adapter socket in the body receiving the threaded stem of the light bulb;

a threaded extension matably received by the light socket of the lamp apparatus, the threaded extension extending into and away from the cavity of the body element in generally co-linear relation with the threaded adapter socket and so that a portion of the threaded extension si surrounded by the cavity, and the remaining portion of the threaded extension being no greater than approximately one-third the longitudinal length of the threaded extension positioned to extend out of the cavity, the threaded extension and the cavity being dimension to define a space that receives at least a portion of the annular surface of the light socket;

wherein the body element carries and contains the electronic means for controlling current flow between the threaded extension and the threaded adapter socket.

* * * * *